US006945835B1

(12) United States Patent
Akhavein

(10) Patent No.: US 6,945,835 B1
(45) Date of Patent: Sep. 20, 2005

(54) FLUSHING SYSTEM AND PROCESS

(76) Inventor: Glenn Akhavein, 5112 Coral Blvd., Bradenton, FL (US) 34210

( * ) Notice: Subject to any disclaimer, the term of this patent is extended or adjusted under 35 U.S.C. 154(b) by 0 days.

(21) Appl. No.: 10/261,730

(22) Filed: Oct. 1, 2002

(51) Int. Cl.[7] ..... B63H 21/10
(52) U.S. Cl. ..... 440/88 N
(58) Field of Search ..... 440/88 R, 88 C, 440/88 D, 88 N, 88 HE, 88 P

(56) References Cited

U.S. PATENT DOCUMENTS 4,619,618 A * 10/1986 Patti ..... 440/88 R
5,599,217 A * 2/1997 Ferrante ..... 440/88 R
5,830,023 A * 11/1998 Brogdon ..... 440/88 R
6,089,934 A * 7/2000 Biggs et al. ..... 440/88 R
6,379,201 B1 * 4/2002 Biggs et al. ..... 440/88 R
6,390,870 B1 * 5/2002 Hughes et al. ..... 440/88 R
6,506,085 B1 * 1/2003 Casey et al. ..... 440/88 N
6,695,660 B1 * 2/2004 Ellis ..... 440/88 C
6,769,943 B1 * 8/2004 Abell ..... 440/88 N

* cited by examiner

*Primary Examiner*—Stephen Avila

(57) ABSTRACT

A flushing system for an inboard and an inboard/outboard marine engine is inserted into the flow path normally used for conducting ambient water to the engine for cooling purposes. A first attachment means allows ambient fluid to flow into the system and a second attachment means allows for ambient fluid to flow out of the system. A first extension means connects the upstream ambient fluid to the flushing system inlet and a second extension means connects the flushing system outlet to the downstream ambient fluid allowing the flushing system to be located some distance from the insertion point.

8 Claims, 5 Drawing Sheets

FIG. 5A
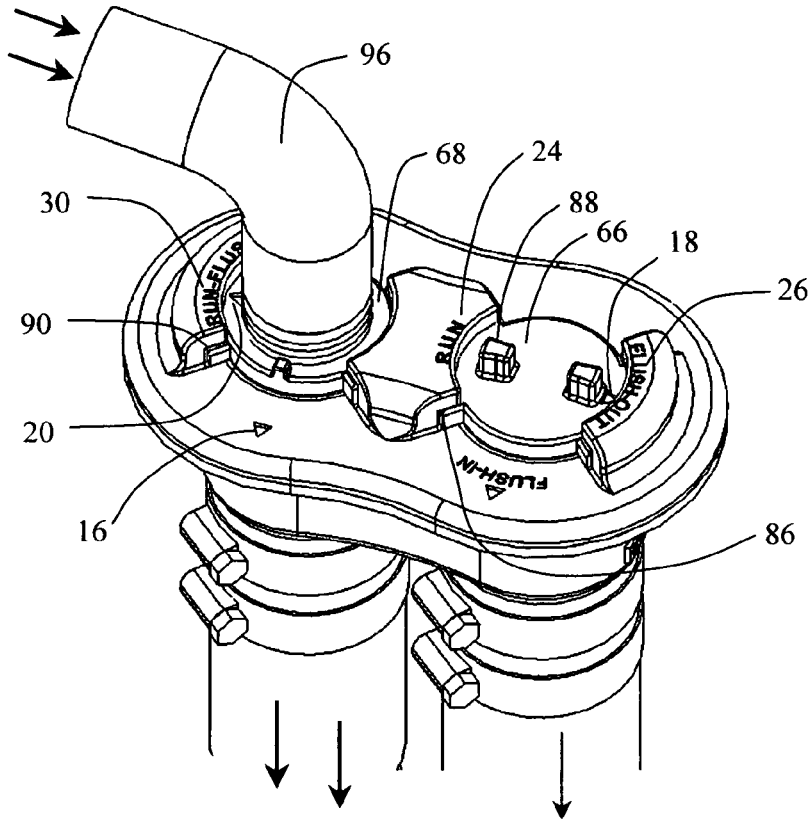
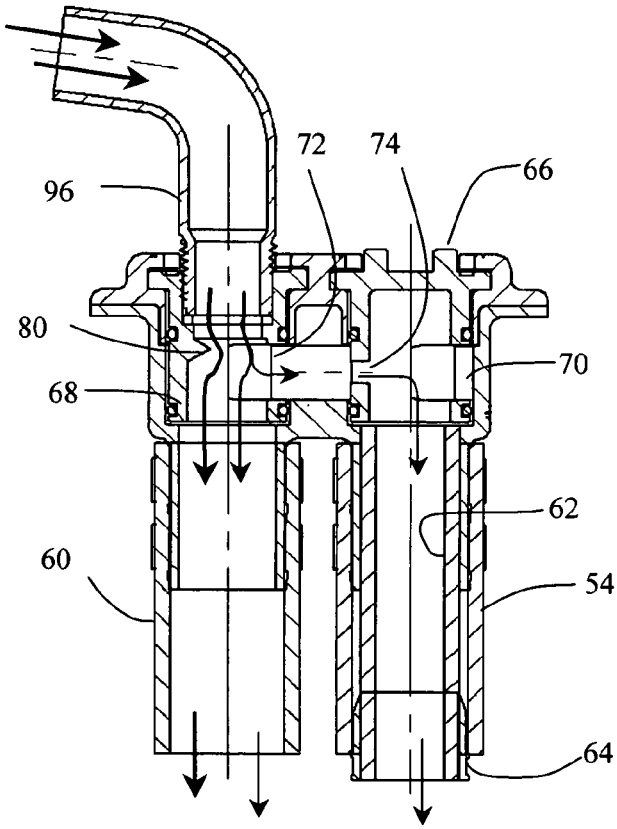
FIG. 5B

FLUSHING SYSTEM AND PROCESS

BACKGROUND OF THE INVENTION

1. Field of the Invention

This invention relates to a novel, yet simple system and process for flushing inboard/outboard marine engines and inboard marine engines with a desired fluid. This system and process allows for any person to quickly and easily flush an engine whether the boat is in the water or out of the water with the engine running.

The need for such systems is commonly seen with marine engines. When a marine engine is operated, in fresh water or salt water, impurities in the water can cause cooling problems and corrosion of components if not properly flushed. Debris of various types can be picked up in lakes and rivers, and even the cleanest ocean water is going to have salt in it. Therefore, it is imperative that marine engines get flushed after every use.

The difficulty is that flushing marine engines, especially some inboard/outboard engines, can be very cumbersome since the intake for cooling fluids is in the vicinity of the propeller. The intake for inboard engines is usually under the boat, with the intake pump located in the vicinity of the engine. In either case, the intake points for flushing the engine are difficult to reach, and the intakes remain underwater unless the boat is physically removed from the water.

The invention eliminates the difficulty of the flushing process. This system has no valves to clog or components to corrode, is accessed from the topside of the boat, is simple to use, is inexpensive, and is easily installed by one that is not versed in the art. The novelty of this invention is in its simplicity.

2. Prior Art

There are a number of approaches to flushing marine engines. Some are designed to flush outboard engines, some inboard engines, some inboard/outboard engines, and some a combination of engines. Those that are known that will work for inboard and/or inboard/outboard engines, such as the present invention, are: U.S. Pat. No. 3,550,612 issued Dec. 29, 1970 to Maxon discloses a purge valve for cooling fluid conduit system; U.S. Pat. No. 4,619,618 issued Oct. 28, 1986 to Patti discloses a fresh water flushing kit; U.S. Pat. No. 5,251,670 issued Oct. 12, 1993 to Bates discloses a flush valve; and U.S. Pat. No. 5,295,880 issued Mar. 22, 1994 to Parker discloses a flushing valve for inboard boat engines, and U.S. Pat. No. 5,830,023 issued Nov. 3, 1998 to Brogden discloses a mini freshwater flushing device.

For the most part, the devices prior to this one involve elongated conduits with multiple valves, manually operated valves, check valves, or have complicated directional control valve mechanisms. Such devices inherently require proper performance of sequential steps that must be completed and then reversed at the end of the flushing process, or rely on check valves, directional control valves, or other devices that are supposed to perform in a specific manner while flushing the engine and then perform in another manner when not in an engine flushing process.

The combination of complicated operational procedures, fluid flow design and flow design components, and the physical locations of such prior art devices often presents the risk that an improper operational procedure or an unknown malfunction of a fluid flow component will expose the vessel to taking on seawater, not functioning correctly under normal operation which can result in ruining a marine engine and/or outdrive components, or at the very least, not properly completing the task for which they are designed, that is, thoroughly flushing a marine engine.

In Maxon and in Parker, a device is situated in the coolant flow path and proper operation of the system is dependent upon either a ball or similar component being displaced by the incoming cooling fluid. Then these components are displaced in the opposite direction during the flushing cycle. While these devices avoid the need for manual intervention, the constant exposure to corrosive environments, abrasive contaminants such as sand and mud, and larger floating debris, can lead to component failure, valve seat failure, as well as failure due to large debris being trapped within the device. This all leads to an inherently unreliable fluid control system over the life of the vessel.

The other significant limitation to both of these devices is that they cannot be used with an inboard/outboard marine engine that has the coolant pump in the outdrive. Any device that is to be used on an inboard/outboard marine engine that has a pump in the outdrive must contain a method for dealing with the fluid that is being pumped from the outdrive. If fluid from the outdrive is not allowed to continue to flow, the pressure on the outlet of the outdrive pump will increase and the pump will, in a matter of just a few minutes, fail.

In Patti and in Bates, a device is also situated in the coolant flow path, and these devices are designed to work with both inboard and inboard/outboard marine engines. However, both of these devices rely upon complicated assemblies and components. As with the previously mentioned devices, the constant exposure to corrosive environments, abrasive contaminants such as sand and mud, and larger floating debris, can lead to component failure, valve seat failure, as well as failure due to large debris being trapped within the devices. This all leads to an inherently unreliable fluid control system over the life of the vessel.

Patti's device consists of a long tubular assembly having a shutoff valve between a seawater inlet and outlet, a second shutoff valve between a freshwater inlet and outlet, and a complicated process for changing from normal operation to flushing and then back again to normal operation. Bates' device does not have anywhere near the complexity in the process of changing from normal operation to flushing and back. However, the device is dramatically more complicated, which makes it more susceptible to the failures mentioned above, and it is a much more expensive design due to the number of sliding seals and the inherent difficulty maintaining this style of seal in the presence of so many abrasive contaminants.

This leads to another problem for both Patti's and Bates' devices; the potential to have port-to-port leakage during the flushing process that cannot be easily determined, if at all. During the flushing process with an inboard/outboard marine engine both the freshwater line and the seawater pump line are pressurized. Over time, if there is wear on the seals, valve seats, or in Bates' case, the body material between the two seals, there can be port-to-port leakage. This has the potential of introducing contaminants and saltwater into the engine during the flushing cycle. Since this is not easily determined, if at all, the signs of this happening will not be apparent until there is substantial damage to the engine, exhaust manifold, or risers, all of which are very expensive to replace.

As previously mentioned, both Patti's and Bates' devices can be used with an inboard or an inboard/outboard marine engine; however, neither of these devices can be used to flush a marine engine with an outdrive pump while the engine is running and the boat is out of the water. It is very important to run a marine engine during the flushing process so that the thermostat remains open. If the engine is off, the cold flushing fluid will immediately cause the thermostat to close, which will in turn close off much of the engine to the flushing fluid thereby dramatically shortening the life of the marine engine.

Boat owners that keep their boats on lifts or davits generally prefer to remove the vessel before beginning a thorough wash down. This allows for a person to rinse the vessel's hull and outdrive while flushing the engine. Also, many commercial establishments, especially ones that are very busy, will remove vessels from the water and complete the exterior wash down and engine flushing service at another location within the establishment.

Brogdon's flushing system does not fit into the existing normal forward flow path of fluid used to flush the engine. A portion of Brogdon's system is attached to the drain or outlet of the engine; however, the normal fluid traveling from the body of water that the vessel is in, through the seawater pump, and onto the engine never passes through the flushing system. Only the flushing fluid used during the flushing cycle passes through the system. Also, the Brogdon flushing system introduces flushing fluid directly into the engine cavities and then out the engine drain in a direction that is reverse of the normal flow of fluid.

These two differences dramatically affect the overall use of the system. First of all, by placing the current flushing system in the normal forward flowing path of cooling fluid, the installation of this flushing system is as simple, inexpensive, and completely compatible with all existing inboard and inboard/outboard engines. More importantly, the Brogdon flushing system cannot be used on an inboard/outboard engine that has the seawater pump in the outdrive. There is no means by which to keep the outdrive impeller pump from overheating and melting.

The next problem, (shortcoming), is introducing flushing fluid directly into multiple parts of the engine to attempt back flush the system. Engines, especially marine engines, have a very sophisticated system designed to introduce coolant to particular parts of the engine with specific volumes. If water is introduced to various parts of a marine engine without having separate flow and pressure restrictors placed on the individual areas that being flushed, the flushing fluid will flow through the paths of least resistance and never reach many of the parts of the engine that get the hottest and/or have the most difficult deposits to remove.

The current flushing system does not suffer from this shortcoming because it introduces the flushing fluid to the marine engine in the same manner that the engine designers intended. This allows flushing fluid to travel into, through, and out of the marine engine in the same manner, pressure and volume, which the raw water travels during normal operation.

Finally, Brogdon's flushing system relies on the building of pressure to shift the shuttle valve. This is stated to be at about fifty psi. Creating this high pressure within marine engines can have dire consequences. The portions of the engine that have elastomeric seals are prone to failing when subjected to high pressures. They are even more prone to failure when subjected to high pressures in the opposite direction that they were designed to seal against.

SUMMARY OF INVENTION

The main object of the current invention is to provide a simple, inexpensive, and reliable method for thoroughly flushing either a marine inboard engine, an inboard/outboard engine with a seawater pump in the engine compartment, or an inboard/outboard engine with a seawater pump in the outdrive while the engine is running and the vessel is either in or out of the water. This invention is novel in its simplicity of design and use.

The device can be situated anywhere on the vessel, but in the preferred embodiment it is located above deck in a location similar to where the gasoline, water, or waste ports are located. The device has an inlet that is spliced into the outlet of the outdrive seawater pump and an outlet that is spliced into the inlet of the engine pump. For engines with the seawater pump in the engine compartment, the device may be spliced in before or after the seawater pump. During normal operation of the vessel seawater simply passes through the device. There are no valves to clog or moving components to corrode.

When the vessel is ready for the flushing cycle, there are two different methods to flush the marine engine depending upon whether the vessel is in or out of the water. In either case, the engine is momentarily turned off, the engine cap is removed from the device to allow a hose to be attached to provide freshwater to the engine pump. The hose could be attached directly to the device; however, in the preferred embodiment, the cap has an inner threaded plug that is removed first, then the cap is removed by turning it 90 degrees. This allows the cap to be easily screwed on to the end of the hose, and with a simple 90 degree turn, the cap and attached hose are inserted back into the device.

If the vessel is in the water the other outdrive cap is removed, again with a simple 90 degree turn, and water from the seawater pump is allowed to flow out of the vessel. In the preferred embodiment, there is an inner hose that is seated under the outdrive cap which can be pulled out so that the water from the outdrive pump is directed over the side of the vessel.

When the flushing cycle is completed, the engine is turned off, the inner hose is slid back into place, the freshwater hose is removed from the engine cap, the engine cap plug is threaded back into place, and both caps are replaced with a simple 90 degree turn. The device can be changed from the normal position to the flushing cycle position and back in well under one minute. Then it is simply up to the individual to decide how long to run the engine to sufficiently flush out the contaminants and any saltwater.

If the vessel is out of the water, the flushing cycle is even simpler. The engine is momentarily turned off, and the freshwater hose is attached as previously mentioned. Then the outdrive cap is simply rotated 180 degrees, and the vessel is ready for flushing. A small portion of the flushing fluid is diverted from going to the engine and is sent to the outdrive pump to flush it and keep it from overheating. Previous devices have no method for providing an outdrive pump with fluid while the engine is running and the vessel is out of the water. Without this diverted fluid, the outdrive pump would run dry and be damaged within the first minute of the flushing cycle.

Another object of this invention is to make the flushing process simple and as close to foolproof as possible. The device is designed and marked in a manner that makes switching from the normal operating position to the flushing position and back, almost intuitive. The device is also designed so that the outdrive cap and the engine cap have clearly marked positions for normal operation, flushing the engine while in the water, and flushing the engine while out of the water. The caps are also designed so that they cannot be locked into an incorrect position, thereby avoiding a situation where the engine may be damaged.

A further object of this invention is to create a device that is very simple to install. A person not skilled in the art of marine installation can easily install this device. A knife, a screwdriver, and a drill are all that is needed. Installation of this device is comparable to that of installing a doorknob.

Another object of this invention is to provide the vessel operator with a method of monitoring the quantity and/or quality of the engine cooling water during normal operation. The current invention does this in a very simple manner. As previously mentioned, in the preferred embodiment, the engine cap has an inner threaded plug that is removed to allow for the attachment of a freshwater hose for flushing. This plug can be produced from a clear material. This provides a close up view of the fluid passing through from the seawater pickup to the engine.

When boating in shallow water, having someone monitor the fluid going to the engine can give a good indication as to how much sand or silt the seawater pump is picking up. This can help reduce wear on the engine. Monitoring the fluid can also be used as a shallow water depth gauge. As the vessels' hull or outdrive approaches the bottom, a drop in depth of just a few inches can dramatically increase the amount of sand and silt that the seawater pump picks up. Those few inches can mean the difference between floating and being grounded, thereby avoiding towing costs as well as the additional costs of running the vessels hull and/or outdrive through the sand.

A further object of this invention is its use as an emergency device. Even though this device is not intended to be used as an emergency device, it can be if it is believed that there could be a loss of life and/or a loss of the vessel. If the vessel is taking on water and the existing bilge pumps are not adequate or not functioning but the engine is still running, this device can be used as an emergency pump.

In an emergency situation, when it is believed that the vessel will sink due to the amount of water coming onboard, the outlet hose from this device can be disconnected at a low point, usually well below the engine. This now becomes the inlet for the engine pump. As the engine runs it becomes a high volume bilge pump. Once the engine begins to pump water from within the vessel, the outdrive cap is removed from the device, in the manner mentioned earlier, and the inner hose is extended so that the fluid from the seawater pump is sent over the side of the vessel.

Once the vessel is no longer in an emergency situation, the device's inner hose and outdrive cap can be replaced, and the outlet hose can be reconnected.

Other aspects of this invention are disclosed infra.

BRIEF DESCRIPTION OF THE DRAWINGS

FIG. 4A–6B are comparison views showing an exterior view and its accompanying cross sectional view of the preferred embodiment of the current invention in its three primary positions; FIG. 4A–B, standard running the engine, FIG. 5A–B, flushing the engine with the vessel out of the water, and FIG. 6A–B, flushing the engine with the vessel in the water.

FIG. 4A is an exterior view of the flushing system in the standard running the engine position. This is the position the flushing system is left in at all times other than when flushing the engine.

FIG. 4B is a cross sectional view of FIG. 4A showing with arrows, as in FIGS. 2 and 3, the direction that the coolant fluid travels in the standard running the engine position.

FIG. 5A is an exterior view of the flushing system while flushing the engine with the vessel out of the water. It shows the attachment of a hose to deliver clean flushing fluids and the position of the major components during the flushing cycle.

FIG. 5B is a cross sectional view of FIG. 5A showing the direction that the coolant fluid travels while flushing the engine with the vessel out of the water. It also shows a cross sectional view of the position of some of the components during the cycle. The arrows illustrate the flow of flushing fluids into the system and the flow, out of the system, of flushing fluid to the engine pump and flushing fluid to the seawater pump.

FIG. 6B is a cross sectional view of FIG. 6A showing the direction that the coolant fluid travels while flushing the engine with the vessel in the water. It also shows a cross sectional view of the position of some of the components during the cycle. The arrows illustrate, on the left, the flow of flushing fluids into the system and out of the system to the engine pump. The arrows also illustrate, on the right, the flow of fluid from the seawater pump into the system through the inner hose, and then overboard.

The same reference numerals refer to the same parts throughout the various Figures.

DETAILED DESCRIPTION OF THE PREFERRED EMBODIMENT

Figure 1:
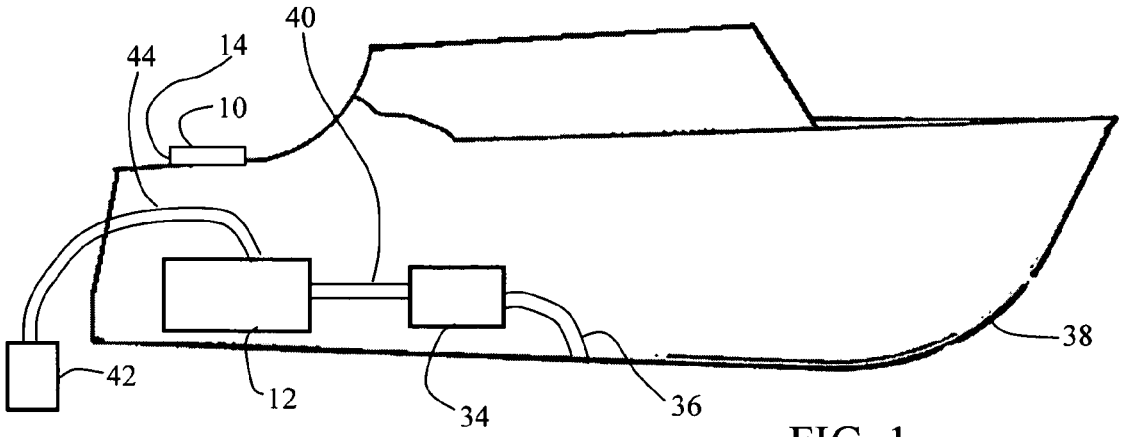
FIG. 1 is a view of the general positioning of the flushing system relative to the vessel's engine and pumps. It also shows the different places where it can be installed depending upon whether the vessel has an inboard engine, inboard/outboard engine with a seawater pump in the engine compartment, or an inboard/outboard engine with a seawater pump in the outdrive.

FIG. 1 shows one possible mounting location for the flushing system 10 relative to the vessel's engine 12. The flushing system 10 is generally installed in the gunwale or the top of the transom. If the flushing system 10 is installed along the side of the vessel, in the gunwale, the propeller indicator 14 points towards the back of the vessel. If the flushing system 10 is installed in the top of the transom, the propeller indicator 14 points towards the center of the vessel. This aids in making the flushing system 10 more intuitive. There are pointers FIG. 2: 16, 18, 20 and 22, and verbal descriptions, 24, 26, 28 and 30, built into the cover 32 that also aid in making the flushing system 10 easy to use. The specific uses for each will be discussed in detail.

The insertion point for the flushing system 10 varies depending upon the type of vessel. For a vessel with a seawater pump 34 in the engine compartment, the flushing system 10 can be spliced into either the conduit 36 between the hull 38 and the seawater pump 34, or the conduit 40 between the seawater pump 34 and the engine 12. If the vessel has an engine 12 with an outdrive pump 42, the insertion point is in the conduit 44 between the outdrive pump 42 and the engine 12.

Figure 2:
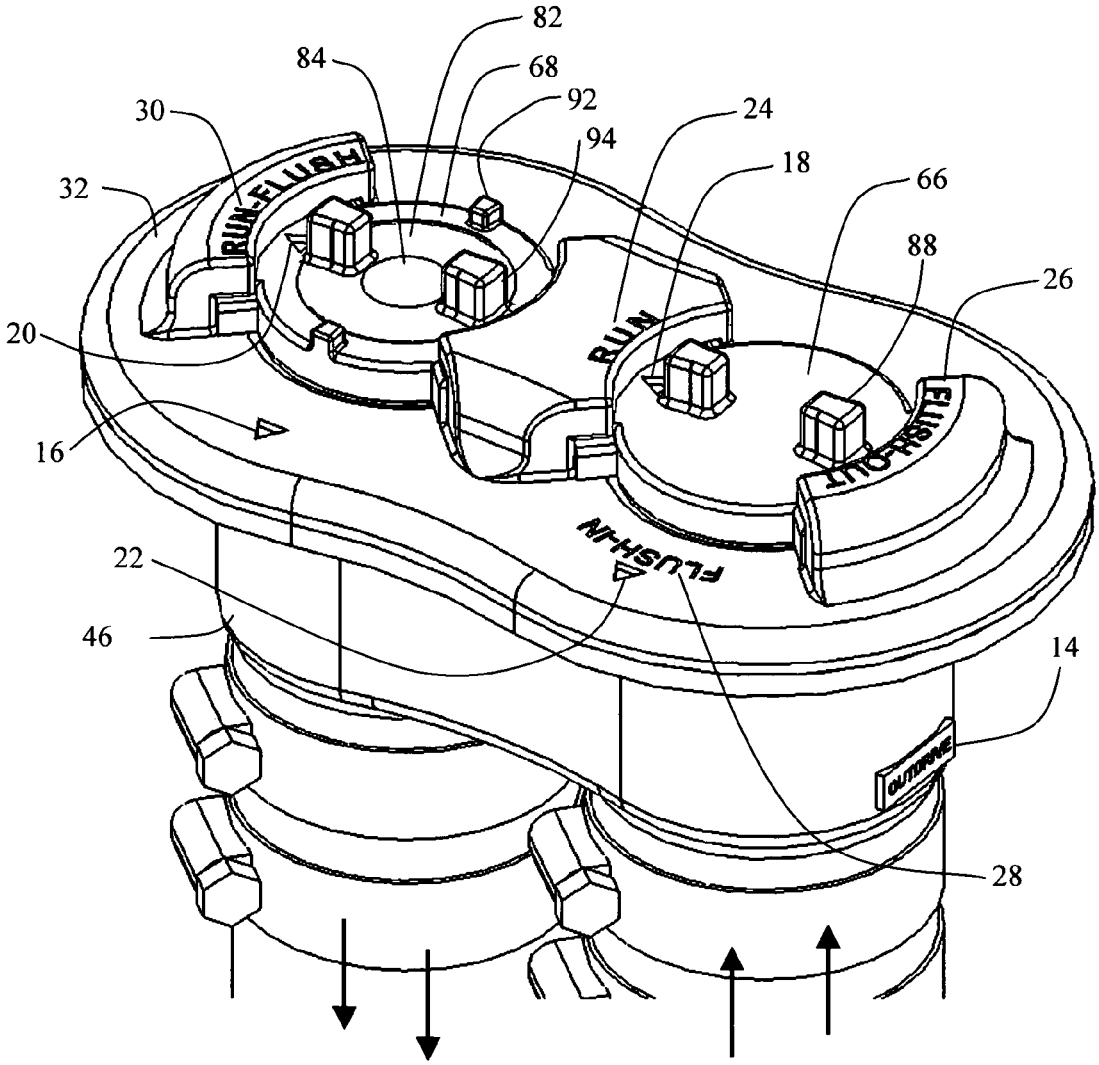
FIG. 2 is an exterior view of the top of the preferred embodiment of the current invention showing the major components of the system in the standard engine running position and illustrating with arrows the flow of fluid from the seawater pump and the flow of fluid to the engine.
Figure 3:
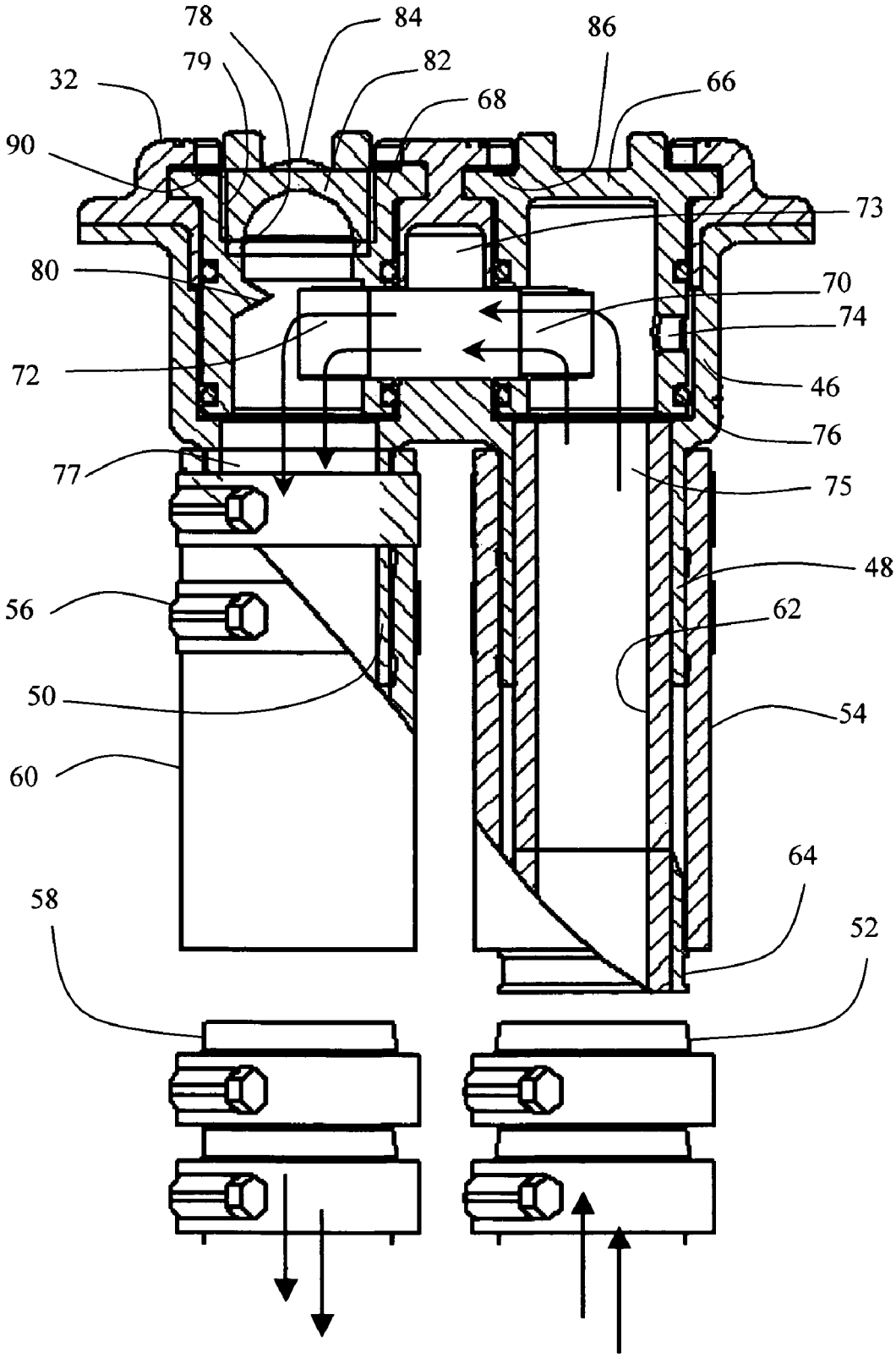
FIG. 3 is a partial section of the preferred embodiment of the flushing system described in the current invention. It shows with arrows, as in FIG. 2, the cooling water coming in and passing through the flushing system.

FIGS. 2 and 3 illustrate an exterior isomeric view of the flushing system 10 and a partial front section in the standard engine running position. The flushing system 10 is comprised of a cover 32 that is attached to the hollow body 46 in a manner that prevents any leakage of fluids between them. The body 46 has an inlet conduit 48 and an engine conduit or outlet 50 that serve as attachment points. The inlet conduit 48 is connected to the incoming cooling fluid conduit or first attachment means 52 by an extension conduit or first extension means 54 that uses a connecting means 56. The engine conduit 50 is connected to the outgoing fluid conduit or second attachment means 58 by an extension conduit or second extension means 60 that uses a connecting means 56. Inside of the inlet conduit 48 is an inner conduit 62 with an attached sealing means 64. Any fluid flowing through the inlet conduit or inlet 48 must do so through the inside of the inner conduit 62 and the attached inner conduit sealing means 64.

During normal operation, cooling fluid is brought into the vessel and sent to the engine. The position indicator 18 on the inlet cap 66 points towards the RUN indicator 24, and the position indicator 20 on the engine cap 68 points towards the RUN-FLUSH indicator 30. This allows the cooling fluid that enters into the body through the inner hose 62 to pass through the main inlet cap opening 70 in the inlet cap 66 and then through the engine cap opening 72 in the engine cap 68 and on to the engine 12 via the engine conduit 50. Any fluid entering the inlet cap 66 and passing through the inlet cap metering orifice 74, will pass along the outside of the inlet cap 66 and be contained by the cap seals 76 until merging with the rest of the fluid passing through the main inlet cap opening 70. All of the fluid entering the flushing system 10 is contained by the inner conduit sealing means 64, the engine cap plug sealing means 78, and a plurality of cap seals 76.

A common chamber 73 lies disposed between the inlet 48 and outlet 50. The common chamber has a plurality of sections that allows for fluid direction and metering means to be inserted, repositioned and removed to direct and meter the flow of fluid into and out of the flushing system. The common chamber is capable of having an internal extending portion 62 that can direct fluid to the rest of the common chamber or direct fluid out of the common chamber.

The cover 32 is attached to the hollow body 46 in a sealed manner so as not to allow leakage between the two. The cover is has an inlet opening 75 and an outlet opening 77. The inlet opening mates to the hollow body 46 allowing for fluid direction and metering means to be inserted, repositioned or removed to direct and meter the flow of fluids into and out of the flushing system 10. The outlet opening 77 mates to said hollow body 46 allowing for fluid direction and metering means to be inserted or removed to direct and meter the flow of fluids into and out of the flushing system 10.

An opening 79 allows for the insertion, retention, and removal of a conduit 96, FIG. 5A, that is used to bring flushing fluid into the flushing system 10. The opening is designed so that said direction and meter means 68 can be left in the flushing system while the flushing fluid conduit is inserted, retained, or removed. The opening is also designed so that said direction and metering means 68 can be removed from the flushing system 10 having the flushing fluid conduit 96 inserted, retained, or removed, and then have the direction and metering means 68 reinserted into the flushing system 10.

During normal operation, the dual-purpose deflector 80 deflects some of the inlet cooling fluid up passed the engine cap plug sealing means 78 and into the engine cap plug 82. The engine cap plug 82 can be made from many materials, but in the preferred embodiment, it would be made from a clear material with a viewing means 84, thereby allowing a person aboard the vessel to easily see if fluid is flowing, and what may be suspended in the fluid; sand, silt, sea grass, etc.

Figure 4A:
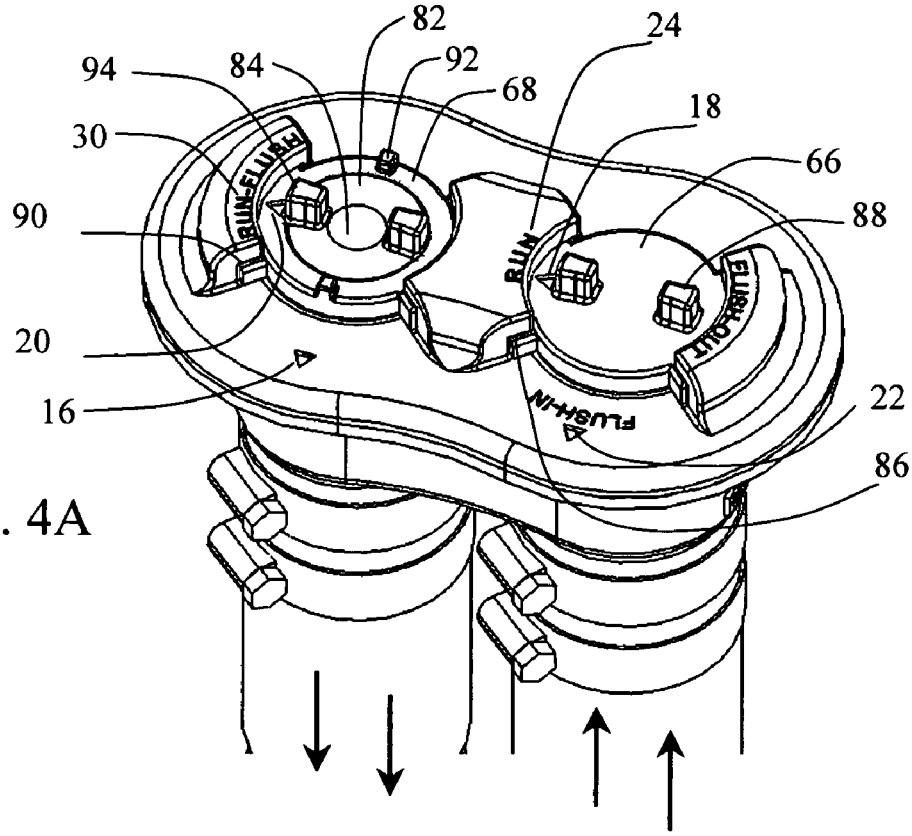
Figure 4B:
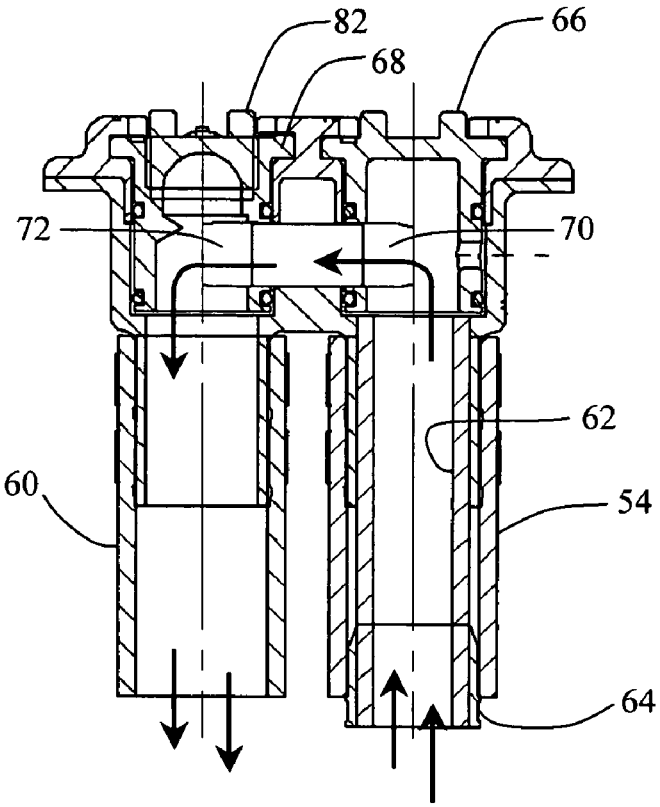

As previously mentioned, when the flushing system 10 is in the standard running the engine position, FIGS. 4A–B, the position indicator 18 on the inlet cap 66 is lined up with the RUN indicator 24 on the cover 32. When in this position, the internal fluid pressure keeps the inlet cap 66 in place. The inlet cap 66 has detents 86 that serve to lock the cap into place during operation. The internal fluid pressure pushes upward on the inlet cap 66 engaging the detents 86 with the cover 32. This ensures that the inlet cap 66 cannot vibrate loose during normal operation. The only way to remove the inlet cap 66 is to push down on the inlet cap 66, push sideways on the inlet cap tabs 88, and rotate the inlet cap 66 until the position indicator 18 on the inlet cap 66 is lined up with the position indicator 22 on the cover 32. When in this position, the inlet cap 66 can be pulled up and removed from the flushing system 10.

This same scenario is used for locking and removing the engine cap 68. When the flushing system 10 is in the standard running the engine position, the position indicator 20 on the engine cap 68 is lined up with the RUN-FLUSH indicator 30 on the cover 32. When in this position, the internal fluid pressure keeps the engine cap 68 in place. The engine cap 68 has detents 90 that serve to lock the cap into place during operation. The internal fluid pressure pushes upward on the engine cap 68 engaging the detents 90 with the cover 32. This ensures that the engine cap 68 cannot vibrate loose during normal operation. The only way to remove the engine cap 68 is to push down on the engine cap 68, push sideways on the engine cap tabs 92, and rotate the engine cap 68 until the position indicator 20 on the engine cap 68 is lined up with the position indicator 16 on the cover 32. When in this position, the engine cap 68 can be pulled up and removed from the flushing system 10.

FIGS. 5A–B shows the same type of two views as seen in FIGS. 4A–B, except this time the flushing system 10 is in the flushing the engine with the vessel out of the water position. Using the method in the previous paragraph, the engine cap 68 is removed from the flushing system 10. Then the engine cap plug 82 is removed from the engine cap 68 by pushing on the engine cap plug tabs 94 and rotating the engine cap plug 82 until it is completely unscrewed from the engine cap 68. Then a conduit 96, generally a standard garden hose, is screwed into the engine cap 68 until is seals against the engine cap plug sealing means 78. The engine cap 68 with attached conduit 96 are reinserted into the flushing system 10 and the position indicator 20 on engine cap 68 is realigned with the RUN-FLUSH indicator 30 on the cover 32. Next, the inlet cap 66 is rotated 180° by pushing sideways on the inlet cap tabs 88 until the inlet cap position indicator 18 is lined up with the FLUSH-OUT indicator 26.

Once in this position the flushing fluid can be turned on and the engine 12 started. FIG. 5B show the direction that the flushing fluid travels. Most of the fluid travels past the dual-purpose deflector 80 and through the engine extension conduit 60 and on to the engine 12. The dual-purpose deflector 80 does deflect some of this flushing fluid out the main engine cap opening 72, through the inlet cap metering orifice 74, out the inner conduit 62, and on to either lubricate and flush the seawater pump 42 or 34 or out the seawater conduit 36. The size and shape of the dual-purpose deflector 80 and the size of the inlet cap metering orifice, ensure that enough fluid will travel back to the seawater pump 42 or 34 to flush it and keep it from overheating or galling.

Once the flushing cycle is complete, the engine 12 is turned off, and the inlet cap 66 is rotated back to where the inlet cap position indicator 18 is lined up with the RUN indicator 24. Next the engine cap 68 is removed, as mentioned earlier, and the flushing fluid hose 96 is unscrewed. The engine cap plug 82 is then screwed back into the engine cap 68 until it seals on the engine cap sealing means 78. Then the engine cap position indicator 20 is lined up with the position indicator 16, and the engine cap 68 is inserted into the cover 32 and rotated until the engine cap position indicator 20 lines up with the RUN-FLUSH indicator 30 on the cover. The flushing system 10 has now been returned to the standard engine running position.

Figure 6A:
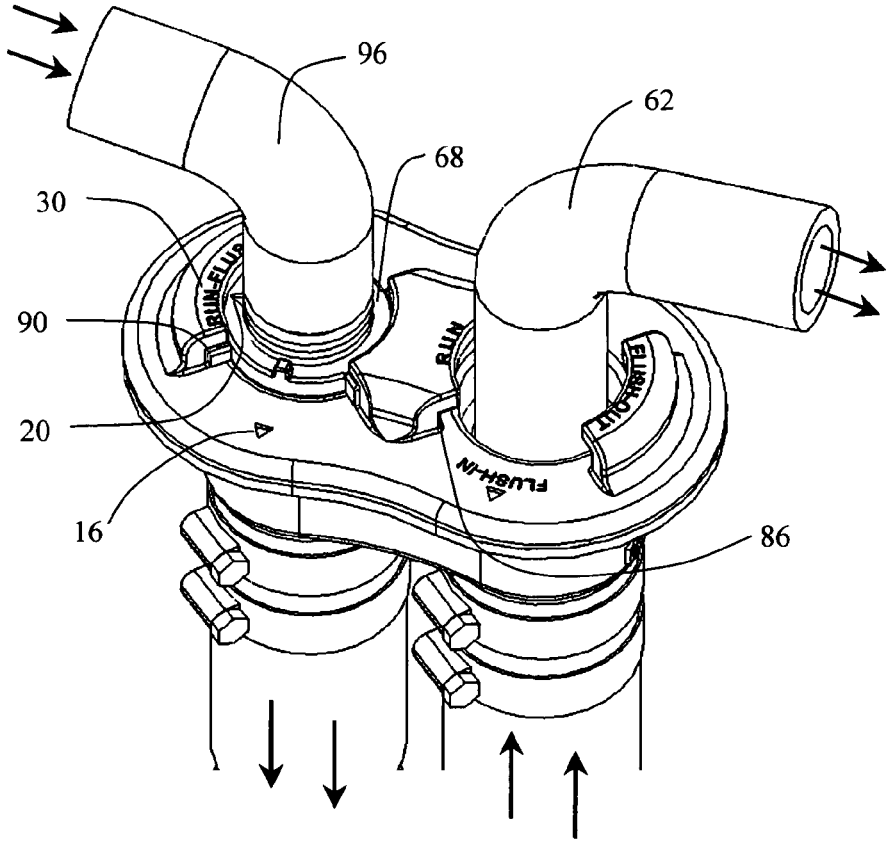
FIG. 6A is an exterior view of the flushing system while flushing the engine with the vessel in the water. It shows the attachment of a hose to deliver clean flushing fluids, and the position of the major components during the flushing cycle, and the position of the interior hose which diverts water from the seawater pump out of the system.
Figure 6B:
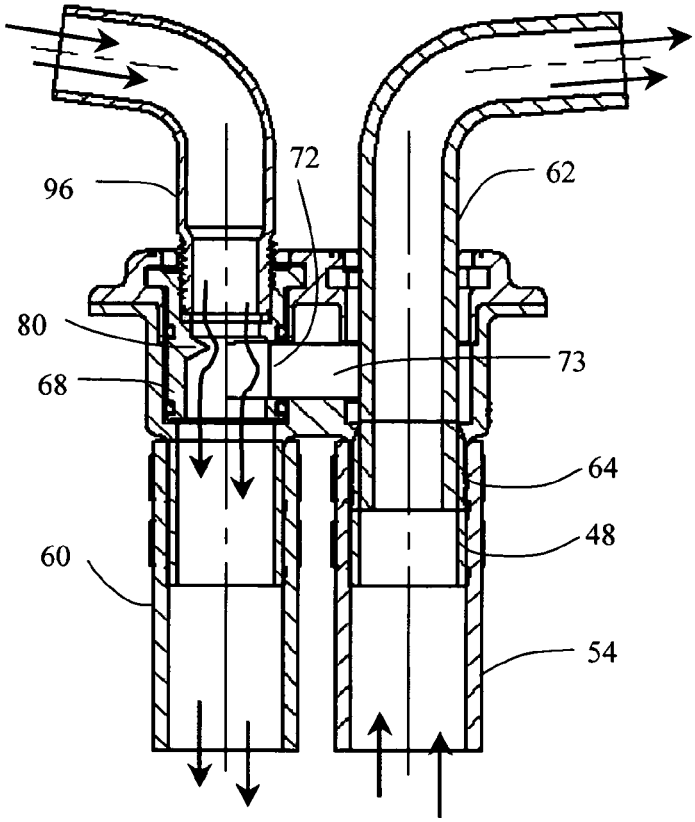

FIGS. 6A–B shows the flushing system 10 in the flushing the engine with the vessel in the water position. To flush the engine with the vessel still in the water, first install the flushing fluid hose 96 as previously mentioned. This time however, the inlet cap 66 is removed from the flushing system 46 by rotating the inlet cap 66 until the inlet cap position indicator 18 is lined up with the FLUSH-IN indicator 28. Next the inlet cap 66 is pulled up and removed from the flushing system 10. This exposes the inner conduit 62. The inner conduit 62 is then pulled all the way out until the attached sealing means 64 seals against the inside of the inlet conduit 48. The free end of the inner conduit 62 is then pointed over the side of the vessel.

Next the flushing fluid is turned on and the engine 12 is started. Since the inlet cap 66 is removed, and the inner conduit sealing means 64 has sealed the entire inlet extension conduit 54, all of the flushing fluid travels to the engine 12. At the same time, fluid from the seawater pump 42 or 34 is allowed to travel its normal route until it gets to the flushing system 10. Instead of passing through the flushing system 10 and on to the engine 12, it is just sent overboard so as not to unduly burden the seawater pump 42 or 34.

Once the flushing cycle is complete, the engine 12 is turned off, the inner conduit 62 is pushed back down into the inlet extension conduit 54, the inlet cap position indicator 18 is lined up with the cover position indicator 22, and the inlet cap 66 is pushed down into place. Then the inlet cap 66 is rotated so that the inlet cap position indicator 18 is lined up with the RUN position indicator 24. Next the engine cap 68 is removed, as mentioned earlier, and the flushing fluid hose 96 is unscrewed. The engine cap plug 82 is then screwed back into the engine cap 68 until it seals on the engine cap sealing means 78. Then the engine cap position indicator 20 is lined up with the position indicator 16 and the engine cap 68 is inserted into the cover 32 and rotated until the engine cap position indicator 20 lines up with the RUN-FLUSH indicator 30 on the cover. The flushing system 10 has now been returned to the standard engine running position.

In case of an emergency-flooding situation aboard a vessel whose engine is still operational, the flushing system 10 can be converted into a high volume pump. The process is similar to the process one would use to flush the engine with the vessel in the water. As mentioned earlier, the insertion point for the flushing system 10 can be conduit 36, conduit 40, or conduit 44. Regardless of which of these insertion points is used, the first step is to remove the connecting means 56 from the bottom of the engine extension conduit 60. This exposes the end of the engine inlet conduit 58 to the flooding water. Since the engine is running the engine inlet conduit 58 will begin to pull in the excess flooding water; however, the seawater pump 42 or 34 will still be pumping water into the same area that the engine 12 is pulling water from. Therefore, to complete the emergency pumping process, the inlet cap 66 is removed as described earlier, and the inner conduit 62 is pulled out just like in the flushing process. Now all of the fluid that is being pulled into the vessel from the seawater pump 42 or 34 is sent overboard, and the engine 12 is using the excess flooding water as coolant and pumping it out of the vessel.

Once the emergency situation has been remedied, the inlet cap 66 is returned to its original running the engine position as previously described, and the engine extension conduit 60 is reattached to the engine inlet conduit 58 using the same connecting means 56.

Although a preferred embodiment of the invention has been described using specific terms, such description is for illustrative purposes only, and it is to be understood that changes and variations may be made without departing from the spirit or scope of the following claims.

What is claimed is:

1. A flushing system for an inboard or an inboard/outboard marine engine that is inserted into the normal forward flowing path used for conducting ambient water to the engine for cooling purposes, said flushing system comprising:

(a) an attachment means that allows for normal forward flowing ambient fluid to flow into the system;

(b) an attachment means that allows for normal forward flowing ambient fluid to flow out of the system;

(c) an extension means that connects the normal forward flowing upstream ambient fluid to the flushing system inlet thereby allowing the flushing system to be located some distance from the insertion point;

said extension means that is capable of having an internal extending portion that can direct fluid to the rest of a common chamber or direct fluid out of said common chamber;

(d) an extension means that connects the flushing system outlet to the normal forward flowing downstream ambient fluid thereby allowing the flushing system to be located some distance from the insertion point.

2. The flushing system as set forth in claim 1 with a hollow body that has a plurality of chambers so as to allow for various fluids to enter the system and be directed into a plurality of directions; the hollow body contains:

(a) the inlet that is attached to the said normal forward flowing upstream ambient fluid extension means;

(b) an outlet that is attached to the said normal forward flowing downstream ambient fluid extension means;

(c) a common chamber that lies disposed between the said inlet and outlet;

said common chamber has a plurality of sections that allow for fluid direction and metering means to be inserted, moved, or removed to direct and meter the flow of fluids into and out of the flushing system;

(d) a feature that allows for the directional installation of said flushing system relative to the vessel's ambient fluid flow path.

3. The flushing system as set forth in claim 1 with a cover that is attached to a hollow body in a sealed manner so as not to allow leakage between the two, said cover comprising:

(a) an inlet opening that mates to said hollow body that allows for fluid direction and metering means to be inserted, repositioned or removed to direct and meter the flow of fluids into and out of the flushing system;

(b) an outlet opening that mates to said hollow body that allows for fluid direction and metering means to be inserted, repositioned or removed to direct and meter the flow of fluids into and out of the flushing system;

(c) a plurality of holding features that allow for a fluid direction and metering means to be inserted, repositioned or retained; and (d) a plurality of indicating symbols and/or alphanumerics that aid in the insertion, removal, or alignment of said fluid direction and metering means.

4. A flushing system as set forth in claim 1 with at least one directional and metering means that can be inserted, repositioned, removed, or retained by a cover that contains:

(a) a plurality of sealing means that ensure that fluids passing through or around the directional and metering means does so without leaking into portions of the flushing system not intended for fluid or without leaking out of the flushing system;

(b) a feature that allows said cover to retain said direction and metering means in a manner that prevents the direction and metering means from accidentally coming out of the cover or changing position;

(c) a plurality of openings and that allow for bi-directional full fluid flow through the direction and metering means or bi-directional partial fluid flow through the direction and metering means; and (d) a turning means used to facilitate the insertion, rotation, and removal of said direction and metering means.

5. The flushing system as set forth in claim 1 with at least one directional and metering means that can be inserted, repositioned, removed, or retained by a cover that contains;

(a) a plurality of sealing means that ensure that fluids passing through or around the directional and metering means does so without leaking into portions of the flushing system no intended for fluid or without leaking out of the flushing system;

(b) a feature that allows said cover to retain said direction and metering means in a manner that prevents the direction and metering means from accidentally coming out of the cover or changing position;

(c) a plurality of openings that allow for bi-directional full fluid flow through the directional and metering means or bi-directional partial fluid flow through the direction and metering means;

(d) a turning means used to facilitate the insertion, rotation, and removal of said direction and metering means;

(e) a deflecting means that causes a portion of the bidirectional fluid flow to be diverted along a path different from the main fluid flow path;

(f) an opening that allows for the insertion, retention, and removal of an inner viewing means comprising of:

a turning means used to facilitate the insertion, rotation, and removal of said direction and metering means;

material that allows said viewing means to be transparent, a sealing means that ensures that fluid passing around said viewing means does so without leaking into portions of the flushing system not intended for fluid or without leaking out of the flushing system;

(g) an opening that allows for the insertion, retention, and removal of a conduit that is used to bring flushing fluid into the flushing system, said opening designed so that said direction and metering means can be left in the flushing system while the flushing fluid conduit is inserted, retained, or removed;

removed from the flushing system have the flushing fluid conduit inserted, retained, or removed, and then have the direction and metering means reinserted into the flushing system.

6. The flushing system as set forth in claim 1 for an inboard or inboard/outboard marine engine that is inserted into the flow path normally used for conducting ambient water to the engine for cooling purposes that can be used as an emergency high volume fluid pump.

7. A method for flushing a marine engine that allows:

(a) a vessel in the water, said method comprising the steps of:

connecting flushing fluid to a flushing system, directing an internal extension so that no raw water from a seawater pump is directed to the marine engine, leaving the marine engine off or running the engine, allowing an adequate amount of fluid to flow through the marine engine shutting off the engine if it was running, redirecting an internal extension so that raw water from the seawater pump will be directed to the marine engine when it is restarted, disconnecting the flushing fluid from the flushing system;

(b) a vessel out of the water, said method comprising the steps of:

connecting the flushing fluid to the flushing system, creating and maintaining enough backpressure within the cooling system so as to force flushing fluid back through the seawater pump, leaving the marine engine off or running the engine, allowing an adequate amount of fluid to flow through the marine engine, shutting off the engine if it was running, disconnecting the flushing fluid from the flushing system.

8. An apparatus for flushing a marine engine that allows:

(a) a vessel in the water, said apparatus comprising of:

a connector that joins the flushing fluid conduit to the flushing system, a component that directs flushing fluid to the marine engine, an internal extension that can be moved or oriented so that raw water from the seawater pump is no longer directed to the marine engine, an internal extension that can be repositioned or reoriented so that raw water from the seawater pump will again be directed to the marine engine when it is restarted, a connector that can disconnect the flushing fluid conduit from the flushing system;

(b) a vessel out of the water, said apparatus comprising of:

a conductor that joins the flushing fluid conduit to the flushing system, a component that directs flushing fluid to the marine engine, a component that is used to create and maintain backpressure within the cooling system so as to force flushing fluid back through the seawater pump, a connector that can disconnect the flushing fluid conduit from the flushing system.

* * * * *